United States Patent [19]

Berezowsky

[11] Patent Number: 4,521,035

[45] Date of Patent: Jun. 4, 1985

[54] PAPER SHEET HOLDERS

[76] Inventor: John W. Berezowsky, 2 Sunset Dr., Senneville, Quebec, Canada, H9X 1S5

[21] Appl. No.: 313,237

[22] Filed: Oct. 20, 1981

[51] Int. Cl.[3] ..... B42F 9/00

[52] U.S. Cl. ..... 281/48; 24/555; 40/530; 412/34

[58] Field of Search ..... 24/201 C, 217 R, 255.4; 46/31; 40/530, 152; 281/42, 45, 46, 47, 48; 402/80 P; 412/33, 34

[56] References Cited

U.S. PATENT DOCUMENTS

| | | | |
|---|---|---|---|
| 316,586 | 4/1885 | Verbeck | 40/530 |
| 460,090 | 9/1891 | Fitzpatrick et al. | 281/48 |
| 2,127,619 | 8/1938 | Rosenthal | 281/17 |
| 2,717,307 | 9/1955 | Bjontegard | 16/225 |
| 2,866,997 | 1/1959 | Eskridge et al. | 16/283 |
| 3,460,282 | 8/1969 | Swirsky | 40/102 |
| 3,768,838 | 10/1973 | Shibata | 402/80 P X |
| 3,793,758 | 2/1964 | Feldhusen et al. | 40/102 |
| 3,845,521 | 11/1974 | McNichol | 24/255 R X |
| 3,956,836 | 5/1976 | Seaborn | 40/530 |
| 4,180,341 | 12/1979 | Langhorst | 402/80 R |

FOREIGN PATENT DOCUMENTS

| | | | |
|---|---|---|---|
| 867924 | 4/1971 | Canada . | |
| 980651 | 12/1975 | Canada . | |
| 2206240 | 8/1973 | Fed. Rep. of Germany | 281/17 |
| 2842625 | 4/1980 | Fed. Rep. of Germany | 281/46 |

*Primary Examiner*—Paul A. Bell

*Attorney, Agent, or Firm*—Larson and Taylor

[57] ABSTRACT

A device for holding paper sheets, magazines, catalogues and the like is disclosed. The device allows different sized U-shaped holders to be clipped, snapped or slid together to form a stack. The device comprises at least one U-shaped sheet holder formed of resilient material having two arms extending from a base, the arms adapted to grip the paper sheets, a rod member extending from the base of the device behind and at one side of the device, a groove behind and at the other side of the device, the rod member in the device adapted to mate with the groove in a substantially similar adjacent device on the one side of the device to form a tongue and groove pivot means, and the groove in the device adapted to mate with the rod member in a substantially similar adjacent device on the other side of the device to form a tongue and groove pivot means.

12 Claims, 12 Drawing Figures

PAPER SHEET HOLDERS

This invention relates generally to holders or binders for paper sheets, magazines, catalogues and the like. More specifically, the invention relates to a device which has a series of paper sheet holders, etc, which may be clipped, snapped or slid together to form a binder.

There are many different types of binders for paper sheets. Perhaps the most common type of binder is a looseleaf binder, such as a ring binder, which requires holes to be punched in the paper sheets, and allows individual sheets to be inserted or removed at random. Such a binder serves a particular purpose, however, in some cases it is required to hold a number of paper sheets, magazines, catalogues, or the like, in such a manner wherein the pages are not spoiled by means of having holes punched therein. U-shaped clips or holders made from resilient material have been used to hold a number of paper sheets together, and various attempts have been made to combine a number of these U-shaped clips into a single binder. Examples of these attempts include U.S. Pat. No. 2,127,619 to Rosenthal and Canadian Pat. Nos. 867,924 and 980,651 to Shibata. All of these patents disclose a system of holding a number of U-shaped holders in a binder.

I have invented a novel device for holding paper sheets which comprises a U-shaped clip or holder formed of resilient material to grip paper sheets, etc., the U-shaped holder having a rod member at one side which joins with a groove in an adjacent holder to form a tongue and groove pivot arrangement and allow pivoting between two adjacent holders and has a groove at the other side to join with a rod member in an adjacent holder at the other side. A plurality of holders can be joined together by this tongue and groove pivot arrangement. The rod on one holder either slides or snaps into the groove of the adjacent holder. Cover pieces may be joined to a stack of holders to form a binder.

My device provides more flexibility in holding paper sheets in that the holders can be of different thicknesses, thus a different number of sheets can be provided in each holder. It also allows for changes in the number of holders in a stack both as to thickness of holders and quantities of holders. Furthermore, the construction of the holding device for paper sheets is simpler than that shown and described in the prior art.

The present invention provides a device for holding paper sheets such as magazines, catalogues and the like, comprising at least one U-shaped sheet holder formed of resilient material having two arms extending from a base, the arms adapted to grip the paper sheets, a rod member extending from the base of the device, behind and at one side of the device, a groove behind and at the other side of the device, the rod member in the device adapted to mate with the groove in a substantially similar adjacent device on the one side of the device to form a tongue and groove pivot means, and the groove in the device adapted to mate with the rod member in a substantially similar adjacent device on the other side of the device to form a tongue and groove pivot means.

The rod member of one device snaps or slides into the groove of an adjacent device and is retained in the tongue and groove pivot arrangement until snapped or slid apart. In other embodiments a plurality of devices having U-shaped holders may be joined together by the rod members mating with the grooves of adjacent devices to form a stack. The stack may include a first cover end piece with a rod member to mate in the groove of the device at one end of the stack, and a second cover end piece having a groove to mate with the rod member of the device at the other end of the stack. A back strip may be joined to one of the cover pieces to extend across the back of the stack. Individual U-shaped holders may be made with two arms at different widths apart so that the number of paper sheets gripped by each holder can be varied. In one embodiment the two arms are curved inwards to more definitely grip the paper sheets. The device may extend for at least the length of the paper sheets or may be formed by a number of clips, each clip gripping a certain number of paper sheets. In yet a further embodiment, two U-shaped holders are integrally formed together in a single device with a flexible strip to allow the holders to flex apart.

In drawings which illustrate the embodiments of the invention,

Figure 1:
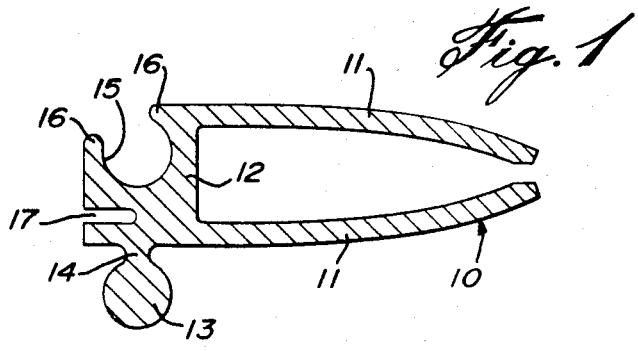
FIG. 1 is a cross sectional view of one embodiment of a device for holding paper sheets according to the present invention.
Figure 2:
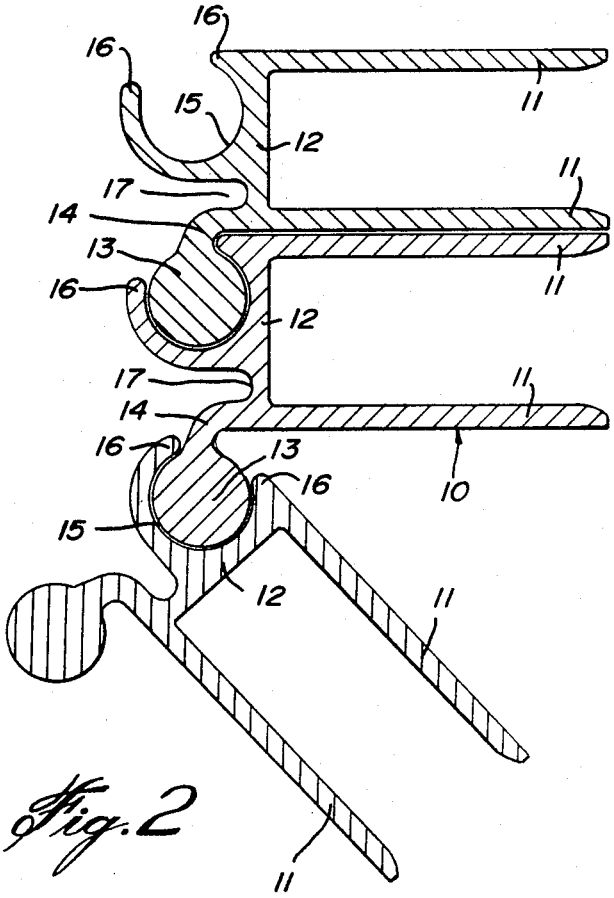
FIG. 2 is a cross sectional view showing another embodiment of three sheet holders joined together with a tongue and groove pivot arrangement.

Referring now to FIGS. 1 and 2, the device for holding paper sheets has a U-shaped holder 10 formed of resilient material with two arms 11 which as illustrated in FIG. 1 are curved inwards at the ends to better grip paper sheets. The arms 11 extend from a base 12 and on the one side of the holder 10 of the device behind the base 12 is a round rod member 13 which extends for the length of the device and has a neck portion 14 joining the rod 13 to the device. At the other side of the device behind the base 12, and in substantially the same plane as the rod member 13, is a groove 15, substantially round, extending for the length of the device. The groove is over 180° around and has two tongues 16 at each side which retain a rod member 13 from an adjacent device when in a tongue and groove arrangement. FIG. 1 shows a slot 17 inwards from the end of the device to allow some resiliencey for the tongue 16 when a rod member 13 is snapped into the groove 15.

Three devices are illustrated joined together in FIG. 2, the arms 11 of the individual holders are substantially parallel, thus each holder 10 is designed to expand slightly to grip a magazine, catalogue or the like, in preference to looseleaf pages. However, looseleaf pages may be held therein if there are a sufficient number to be gripped by the holder. The top device is shown pivoted upwards, the angle of pivot is sufficient for pages to be opened in each holder without having interference from holders on either side.

The rod member 13 of one device snaps or slides into the groove 15 of an adjacent device. The tongue and groove pivot arrangement cannot separate without being slid or snapped apart, because the tongues 16 have to flex to provide a sufficiently large opening in the groove 15 for the rod member 13 to be removed. Each device pivots about the tongue and groove pivot arrangement between two adjacent devices. If it is decided that an exact number of devices is required in the stack, then the rod member 13 on the last device in the stack may be cut off to provide a smooth stack assembly.

The material of construction for the U-shaped sheet holders is preferably an extrusion from ABS thermoplastic polymer blend, or other type of styrene polymer. Alternatively, the resilient material may be aluminum. Other suitable materials which are sufficiently resilient to grip the paper sheets and to allow flexibility for the rod to be snapped into the groove may be used.

Figure 3:
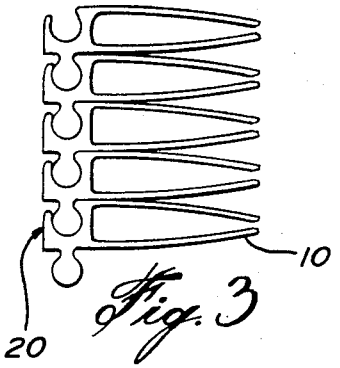
FIGS. 3–6 are cross sectional views of a stack of sheet holders, each sheet holder in individual stacks being identical, but the sheet holders being different sizes in each figure.
Figure 4:
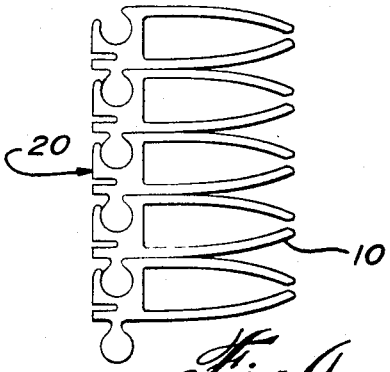
Figure 5:
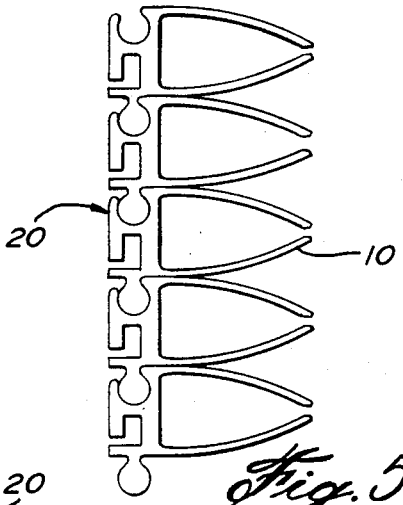
Figure 6:
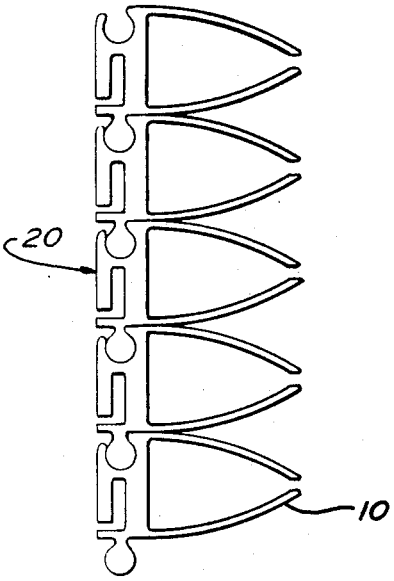
Figure 7:
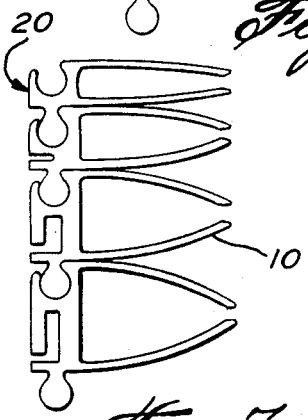
FIG. 7 is a cross sectional view of a stack of devices of different sizes to hold a different number of paper sheets.

The U-shaped sheet holders may be made to hold a different number of sheets. FIG. 3 illustrates a stack 20 of paper holders which have a 3/16" wide U, FIG. 4 illustrates paper holders which have a ¼" wide U, FIG. 5 illustrates paper holders which have a 3/8" wide U, and FIG. 6 illustrates paper holders which have a ½" wide U. The paper holders may be made with the width of the U at any desired dimension, or may be made for a specific type of magazine or catalogue or, alternatively, they may be used for looseleaf holders. FIG. 7 illustrates a stack 20 of devices with paper holders of varying thicknesses, so that a mix of papers, magazines or catalogues may be included in one stack.

Figures 8, 9:
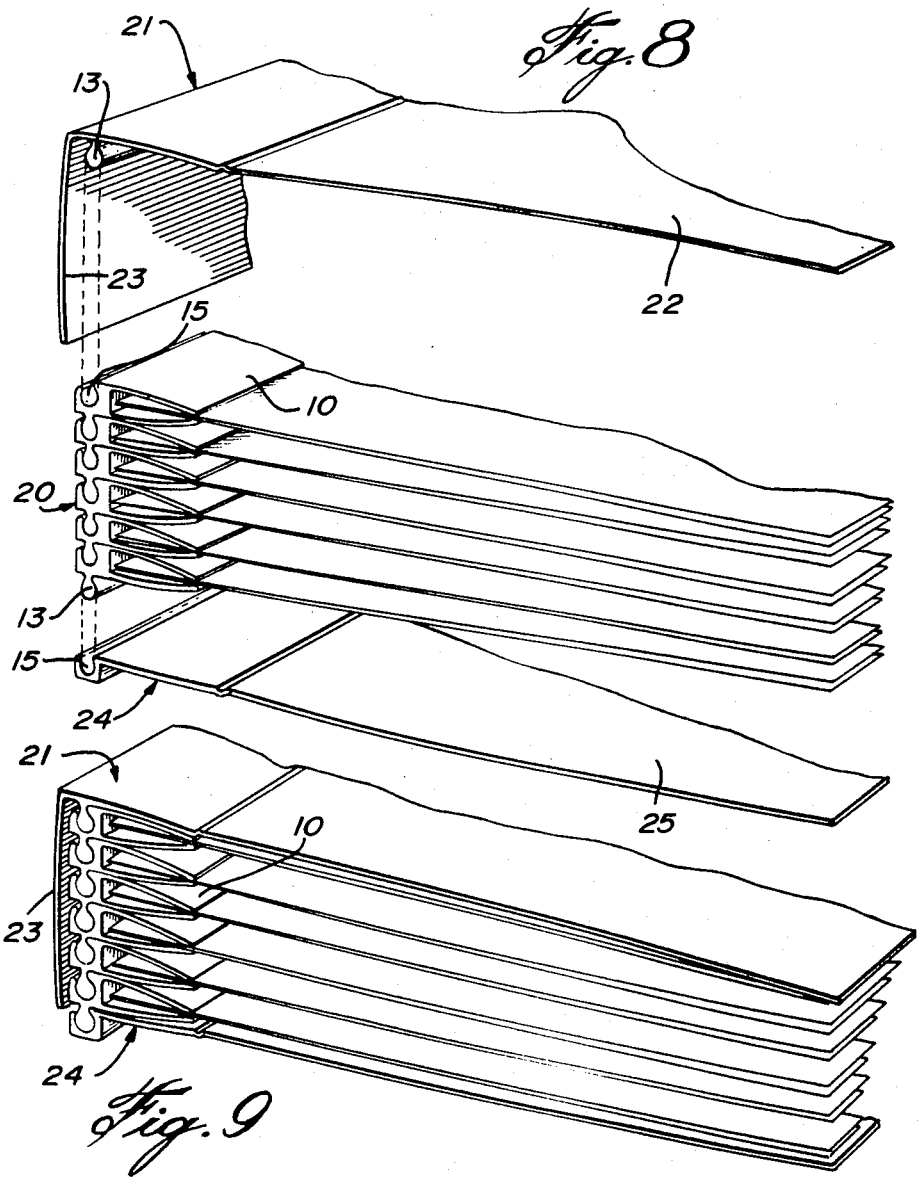
FIG. 8 is an isometrical view of a stack of devices with a first cover piece having a backing strip, and a second cover piece separate from the stack.
FIG. 9 is an isometrical view of an assembled binder comprising a stack of devices and cover pieces.

FIGS. 8 and 9 illustrate a stack 20 of devices with a first cover end piece 21 having a cover sheet 22 extending over the face of the papers and a backing strip 23 extending downwards across the back of the stack 20. The cover may be made from resilient material similar to that from which the individual devices are made or from any other suitable sheet material, rigid or resilient, such as metal, plastic, linerboard, etc. The first cover end piece 21 has a rod member 13 which mates with a groove 15 on the top device of the stack 20. A second cover end piece 24 has a cover sheet 25 which extends over the face of the papers. The second cover end piece 24 has a groove 15 to mate with a rod member 13 in the bottom device of the stack 20. The paper holders 10 all extend for the full length of the paper and are in fact longer than the paper sheets, so the edges of the paper are protected by the covers 22, 25. The assembled unit is shown in FIG. 9 and provides a simple binder for retaining loose-leaf papers, magazines and the like.

Figure 10:
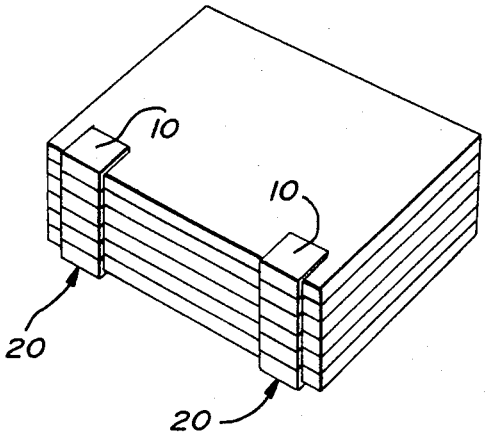
FIG. 10 is an isometric view of a stack of devices in the form of clips holding a number of magazines or catalogues together.

FIG. 10 illustrates a plurality of devices with U-shaped holders 10 in the form of clips which join together in the same manner by the tongue and groove pivot means to form a stack 20. Two stacks 20 are illustrated in FIG. 10 to hold magazines, catalogues or the like. For large paper sheets or magazines more than two clips may be used.

Figure 11:
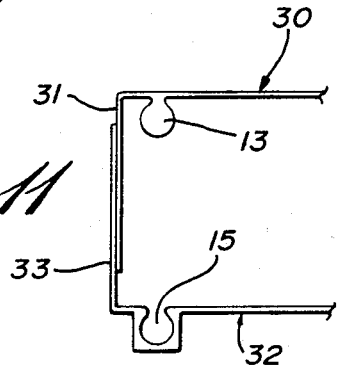
FIG. 11 is an end view showing a cover for use with a stack of holders.

Another cover arrangement is shown in FIG. 11 having a first cover piece 30 with a rod member 13 to mate with a groove 15 in a top device of a stack. The first cover piece 30 having a back cover 31 which extends part way across the back or spine of the stack. A second cover piece 32 has a groove 15 to mate with a rod member 13 of a bottom device of the stack, and a back cover 33 which overlaps the back cover 31 of the first cover piece 30. The back covers 31, 33 can be made to overlap for the full width of the stack or have a minimum overlap.

Figure 12:
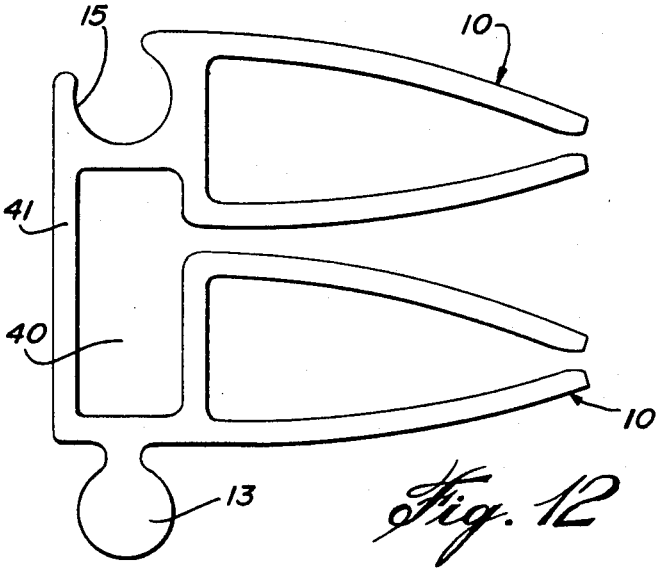
FIG. 12 is a cross sectional view of another embodiment of the present invention with a double holder for paper sheets.

The embodiment shown in FIG. 12 has two sheet holders 10 integrally formed together in one device with a rod member 13 on one side and a groove 15 on the other side to match with single sheet holder devices or other double holder devices. A space 40 is located beneath the two holders 10 which are not joined together except at a back strip 41 thus allowing flexibility between the two holders. As the material is resilient the back strip 41 bends and the two holders 10 tend to pivot or bend apart to allow pages in each holder to be opened for reading. If it is desired inserts may be placed on each side of the double holder device in the space 40 to allow the device to be supported at each end in a "Pendex" (T.M.) type holder.

Various changes may be made to the device for holding paper sheets such as the material of construction may be any suitable material. The configuration of the tongue and groove pivot arrangement may be varied provided the paper holders can pivot between adjacent devices. Covers may incorporate special designs or labels thereon as required for each situation. The scope of the present invention is limited only by the following claims.

The embodiments of the invention in which an exclusive property or privilege is claimed are defined as follows:

1. a device for holding paper sheets such as magazines, catalogues and the like comprising:

at least one U-shaped sheet holder integrally formed of resilient material having two arms extending frontally of a base, the arms being adapted to grip the paper sheets, a rod member extending from one side of said base of the holder and rearwardly of said arms, said rod member being integrally formed with said base and connected to said base by a substantially rigid short neck, a groove behind and at the other side of the holder, said groove being formed in said base and provided with an opening which is substantially larger than the width of said neck, the rod member in the holder being adapted to mate with the groove in a substantially similar adjacent device on the one side of the holder and to pivot therein so as to form a tongue and groove pivot means, and the groove in the holder being adapted to mate with the rod member in a substantially similar adjacent device on the other side of the holder and to pivot thereabout so as to form a tongue and groove pivot means, the U-shaped sheet holder being in the form of a short clip and at least two clips being required to grip the paper sheets.

2. A device of holding paper sheets such as magazines, catalogues and the like comprising:

a plurality of U-shaped sheet holders each integrally formed of resilient material having two arms extending frontally of a base, the arms being adapted to grip the paper sheets, a rod member extending from one side of said base of each holder and rearwardly of said arms, said rod member being intergrally formed with said base and connected to said base by a substantially rigid short neck, a groove behind and at the outer side of each holder, said groove being formed in said base and provided with an opening which is substantially larger than the width of said neck.

the rod member in each holder mating with the groove in an adjacent holder on the one side of the first mentioned holder and to pivot therein so as to form a tongue and groove pivot means, and the groove in each holder mating with the rod member of an adjacent holder on the other side of the first mentioned holder and to pivot thereabout so as to form a tongue and groove pivot means, said plurality of U-shaped holders being joined together by corresponding rod members mating with the grooves of adjacent holders to form a stack, said device further including a first cover end piece having a rod member mating in the groove of the holder at one end of the stack and a second cover end piece having a groove mating in the rod member of the holder at the other end of the stack, the first cover end piece having a back strip that extends across the back of the stack.

3. A device for holding paper sheets such as magazines, catalogues and the like comprising:

a plurality of U-shaped sheet holders each integrally formed of resilient material having two arms extending frontally of a base, the arms being adapted to grip the paper sheets, a rod member extending from one side of said base of each holder and rearwardly of said arms, said rod member being integrally formed with said base and connected to said base by a substantially rigid short neck, a groove behind and at the other side of each holder, said groove being formed in said base and provided with an opening which is substantially larger than the width of said neck, the rod member in each holder mating with the groove in an adjacent holder on the one side of the first mentioned holder and to pivot therein so as to form a tongue and groove pivot means, and the groove in each holder mating with the rod member in an adjacent holder on the other side of the holder and to pivot thereabout so as to form a tongue and groove pivot means, individual ones of said U-shaped sheet holders being made with the two arms at different widths apart, so that the number of paper sheets gripped by each holder can be varied.

4. The device according to claim 3 wherein the rod member of one device snaps or slides into the groove of an adjacent device and is retained in the tongue and groove pivot means arrangement until snapped or slid apart.

5. The device according to claim 3 wherein the two arms are curved inwards to more definitely grip the paper sheets.

6. A device for holding paper sheets such as magazines, catalogues and the like comprising:

at least one U-shaped sheet holder integrally formed of resilient material having two arms extending frontally of a base, the arms being adapted to grip the paper sheets, a rod member extending from one side of said base of the holder and rearwardly of said arms, said rod member being integrally formed with said base and connected to said base by a substantially rigid short neck, a groove behind and at the other side of the holder, said groove being formed in said base and provided with an opening which is substantially larger than the width of said neck, the rod member in the holder being adapted to mate with the groove in a substantially similar adjacent device on the one side of the holder and to pivot therein so as to form a tongue and groove pivot means, and the groove in the holder being adapted to mate with the rod member in a substantially similar adjacent holder on the other side of the device and to pivot thereabout so as to form a tongue and groove pivot means, said sheet holder with two arms, rod member and groove being of unitary construction formed by extrusion.

7. The device according to claim 6 wherein the resilient material is ABS thermoplastic polymer blend.

8. The device according to claim 6 wherein the resilient material is aluminum.

9. The device according to claim 6 wherein the U-shaped sheet holder extends for at least the end of the paper sheets.

10. The device for holding paper sheets such as magazines, catalogues and the like comprising:

at least one U-shaped sheet holder integrally formed of resilient material having two arms extending frontally of a base, the arms being adapted to grip the paper sheets, a rod member extending from one side of said base of the holder and rearwardly of said arms, said rod member being integrally formed with said base and connected to said base by a substantially rigid short neck, a groove behind and at the other side of the holder, said groove being formed in said base and provided with an opening which is substantially larger than the width of said neck, the rod member in the holder being adapted to mate with the groove in a substantially similar adjacent device on the one side of the holder and to pivot therein so as to form a tongue and groove pivot means, and the groove in the holder being adapted to mate with the rod member in a substantially similar adjacent device on the other side of the holder and to pivot thereabout so as to form a tongue and groove pivot means, two of said U-shaped sheet holders being integrally formed together in the device, the sheet holders being disposed in side-by-side relationship and a flexible strip extending between the holders to allow the holders to flex apart.

11. The device according to claim 10 including a hollow space behind the two U-shaped holders.

12. The device according to claim 11 including an insert extending from the hollow space at each end of the device adapted to allow the device to be supported at each end.

* * * * *